US006858318B2

(12) United States Patent
Kogiso et al.

(10) Patent No.: US 6,858,318 B2
(45) Date of Patent: Feb. 22, 2005

(54) METALIC NANOWIRE AND PROCESS FOR PRODUCING THE SAME

(75) Inventors: Masaki Kogiso, Ibaraki (JP); Toshimi Shimizu, Ibaraki (JP)

(73) Assignees: Japan Science and Technology Corporation, Saitama (JP); National Institute of Advanced Industrial Science and Technology, Chiyoda-Ku (JP)

( * ) Notice: Subject to any disclaimer, the term of this patent is extended or adjusted under 35 U.S.C. 154(b) by 79 days.

(21) Appl. No.: 10/182,925

(22) PCT Filed: Sep. 17, 2001

(86) PCT No.: PCT/JP01/08072

§ 371 (c)(1),
(2), (4) Date: Jul. 29, 2002

(87) PCT Pub. No.: WO02/072930

PCT Pub. Date: Sep. 19, 2002

(65) Prior Publication Data

US 2004/0028936 A1 Feb. 12, 2004

(30) Foreign Application Priority Data

Mar. 8, 2001 (JP) ..... 2001-064322

(51) Int. Cl.[7] ..... D01F 4/00; D01F 9/08

(52) U.S. Cl. ..... 428/606; 75/362; 75/370; 75/373; 75/952; 530/333; 530/345

(58) Field of Search ..... 428/606; 75/343, 75/362, 370, 371, 373, 952; 530/333, 345

(56) References Cited

U.S. PATENT DOCUMENTS 3,132,022 A * 5/1964 Luborsky et al. ..... 428/606
3,597,822 A * 8/1971 Fehlner ..... 428/85
5,581,091 A * 12/1996 Moskovits et al. ..... 257/9
6,136,956 A 10/2000 Kogiso et al. ..... 530/359
6,512,119 B2 * 1/2003 Bratkovski et al. ..... 546/104
6,522,446 B2 * 2/2003 Saxe ..... 359/237
6,663,797 B2 * 12/2003 Bratovski et al. ..... 252/500
2002/0055239 A1 * 5/2002 Tuominen et al. ..... 438/466
2003/0079999 A1 * 5/2003 Penner et al. ..... 205/775

FOREIGN PATENT DOCUMENTS

GB 2038532 * 7/1980

OTHER PUBLICATIONS

Provisional application U.S. 60/306,715, filed Jul. 20, 2001. No copy available at time of mailing.*

Pileni et al. Template Design of Microreactors with Colloidal Assemblies: Control the Growth of Copper Metal Rods, Langmuir, vol. 14, 1998, p. 7359–7363.

* cited by examiner

*Primary Examiner*—John J. Zimmerman
(74) *Attorney, Agent, or Firm*—Gary C Cohn PLLC

(57) ABSTRACT

A nanowire comprising only metal having an average length of 1 μm or more which could not be produced in the prior art, and a method of manufacturing this wire.

This invention provides a method of manufacturing a metal nanowire, which comprises the step of reducing a nanofiber comprising a metal complex peptide lipid formed from the two-headed peptide lipid represented by the general formula (I):

(I)

in which Val is a valine residue, m is 1–3 and n is 6–18, and a metal ion, using 5–10 equivalents of a reducing agent relative to the two-headed peptide lipid. It further provides a metal nanowire having an average diameter of 10–20 nm and average length of 1 μm or more. It is preferred that the metal is copper.

8 Claims, 1 Drawing Sheet

METALIC NANOWIRE AND PROCESS FOR PRODUCING THE SAME

TECHNICAL FIELD OF THE INVENTION

This invention relates to a nanowire comprising only metal, and to a method of manufacturing same. More specifically, it relates to a metal nanowire of average length at least 1 μm, and its method of manufacture. This metal nanowire can be used as a nanoelectron part or nanomagnetic material in industrial fields such as electronics/information.

Prior Art

In the prior art, a method is known for manufacturing a copper cylinder structure wherein an organic solution containing water in which an organic aerogel-forming material complexed with copper (II) ion is reduced by hydrazine (e.g., M. P. Pileni et. al., Lamgmuir 1998, 14, 7359–7363). However, the cylindrical structure obtained by this method ranges at most from several tens to several hundred nm, and it was not possible to produce a long fiber structure.

It is disclosed in Japanese Patent No. 3012932 that, when an aqueous solution containing a two-headed peptide lipid as alkali metal salt is left to stand in steam saturated with a 1–5 wt % acidic solution, microfine fibers are obtained due to the one-dimensional crystal growth or self-deposition of this peptide lipid. However, the fibers obtained by this method comprised only organic substances.

On the other hand, the inventors have already reported that a hybrid nanofiber is obtained by adding a metal ion to the alkali metal salt of a two-headed lipid ("Manufacture of Organic/Inorganic Hybrid Nano-Structures by Self-deposition", in No. 49 Polymer Symposium, on Sep. 29, 2000). This fiber is a hybrid of an organic substance and a metal, and was not a fiber comprising only metal.

Problems to be Solved by the Invention

It is therefore an object of this invention, by making use of these facts, to provide a nanowire comprising only metal having an average length of 1 μm or more which could not be produced in the prior art, and a method of manufacturing this wire.

Means to Solve the Problems

The inventor, as a result of intensive studies to develop a simple method of manufacturing a metal nanowire having an average length of at 1 μm or more, discovered that it was possible to manufacture such a nanowire comprising only metal and having a length of 1 μm or more which was not available in the prior art, by chemically reducing a hybrid nanofiber produced by adding a metal ion to a two-headed peptide lipid using 5–10 equivalents of a reducing agent in water.

Specifically, it is an object of this invention to provide a method of manufacturing a metal nanowire, which comprises the step of reducing a nanofiber comprising a metal complex peptide lipid formed from the two-headed peptide lipid represented by the general formula (I):

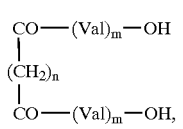

(I)

in which Val is a valine residue, m is 1–3 and n is 6–18, and a metal ion, using 5–10 equivalents of a reducing agent relative to the two-headed peptide lipid.

According to this method, a nanofiber for which the initial concentration of the metal complex peptide lipid is 0.1–1 mmoles/liter may be reduced in aqueous solution using copper (II) ion as the metal ion and sodium borohydride as the reducing agent, or a nanofiber for which the initial concentration of the metal complex peptide lipid is 10–15 mmoles/liter may be reduced in aqueous solution using copper (II) ion as the metal ion and hydrazine as the reducing agent. This initial concentration means the concentration of the metal complex peptide lipid in aqueous solution prior to adding the reducing agent.

It is a further object of this invention to provide a metal nanowire having an average diameter of 10 to 20 nm and an average length of 1 μm or more. It is preferred that this metal is copper.

DETAILED DESCRIPTION OF THE INVENTION

Figure 1:
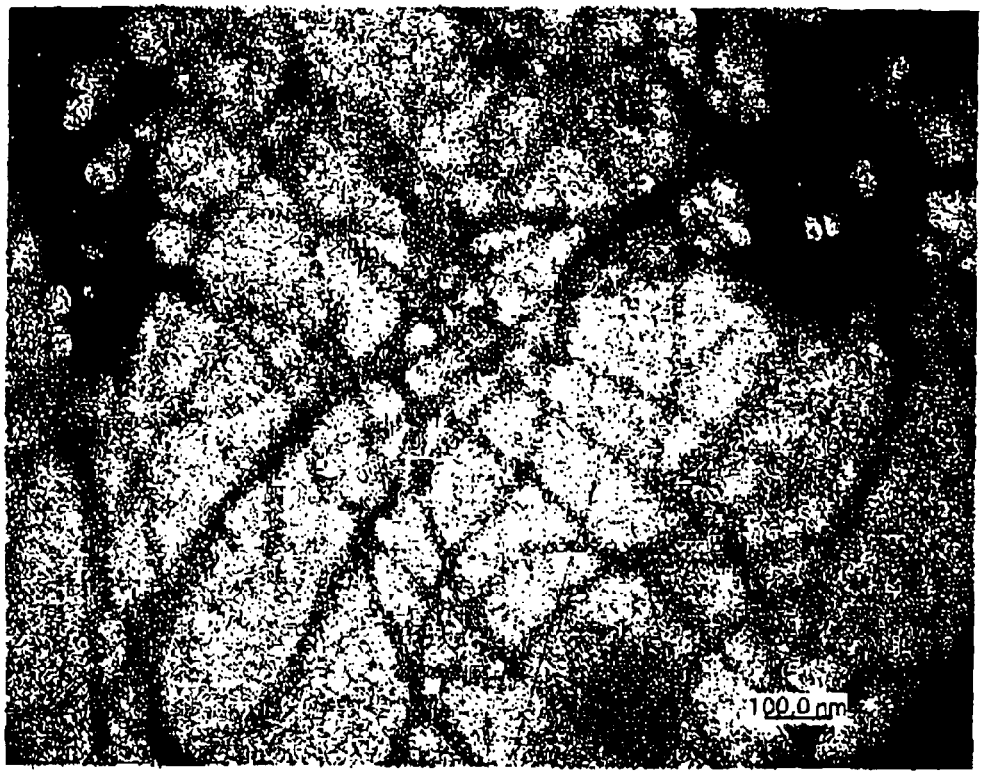
FIG. 1 is a transmission electron micrograph of a copper nanowire obtained by Example 1.

The method of manufacturing the metal nanowire of this invention comprises the steps of making a colloidal dispersion of nanofibers by adding a metal ion to an aqueous solution containing the two-headed peptide lipid represented by the following general formula (I)

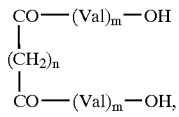

(I)

in which Val, m and n are identical to the above, and adding a reducing agent.

The two-headed peptide lipid having a structure represented by the following general formula (I):

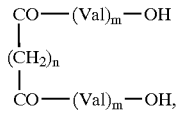

(I)

in which Val, m and n are identical to the above, is formed by joining the oligomer of an optically active L-valine residue or D-valine residue to a long chain dicarboxylic acid via an amide bond, having the C terminal of the oligopeptide chain at both ends.

The valine residue forming the oligopeptide chain is represented by the following formula:

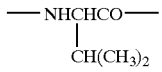

and its optical activity must be entirely D or L.

If a different optically active substance is contained therein, a nanofiber is not formed and a particulate amorphous solid is formed instead. m is 1–3. If m is 4 or higher, the solubility of the compound is poorer, and it is difficult to manufacture the nanofiber of this invention. Further, n gives the length of the straight chain alkalene group, and is 6–18. Examples of this alkalene group are hexalene, heptylene, octalene, nonalene, decylene, undecyline, dodecylene, tetradecylene, hexadecylene and octadecylene. If n is less than 6, it is difficult to form the nanofiber, and if it is higher than 18, the precipitates formed in the aqueous medium become amorphous spheres.

When a metal ion is added to the sodium salt of this two-headed lipid in aqueous solution, as a result of self-deposition, a colloidal dispersion is formed. Although there is no particular limitation on conditions such as temperature, it is desirable to stir the mixture well. Examples of this metal ion are $Mn^{2+}$, $Fe^{3+}$, $Co^{2+}$, $Ni^{2+}$, $Cu^{2+}$ and $Zn^{2+}$, but $Cu^{2+}$ is to be preferred. Any method may be used to introduce this metal into the reaction liquor, but it is convenient to introduce it as a metal salt. For this purpose, a salt of an inorganic acid or an organic acid may be used.

When the reducing agent is added to this colloidal solution, the metal nanowire is produced. Specifically, as the two-headed lipid is dissolved in water as the sodium salt by reduction, a nanowire comprising only metal obtained. There is no particular limitation on conditions such as temperature, but it is preferable to continue stirring.

There is no particular limitation on the reducing agent, examples being hydrogen, or relatively unstable hydrogen compounds such as hydrogen iodide, hydrogen sulphide, aluminium lithium hydride and sodium borohydride, lower oxides or salts of lower oxides such as carbon monoxide, sulphur dioxide and bisulphates; sulphur compounds such as sodium sulphide, sodium polysulphide and ammonium sulphide; metals having a high electropositivity such as alkali metals, magnesium, calcium and aluminum, and their amalgams; or organic compounds having a low oxidation state such as aldehydes, sugars, formic acid, oxalic acid and hydrazine, but sodium borohydride or hydrazine are preferred.

The amount of reducing agent is 5–10 equivalents relative to the two-headed peptide lipid. When the amount of reducing agent is less than 5 equivalents, reduction does not proceed to completion, and when it is higher than 10 equivalents, reduction proceeds so rapidly that large lumps are formed and the copper nanowire is not formed.

It is preferred to suitably select the concentration of the metal complex peptide lipid in the colloidal dispersion when the reducing agent is added, according to the strength or weakness of the reducing agent. If a reducing agent having strong reducing properties is used, the concentration (initial concentration) of the two-headed peptide lipid when the reducing agent is added is preferably low, whereas when a reducing agent having weak reducing properties is used, the concentration (initial concentration) of the two-headed peptide lipid when the reducing agent is added is preferably high. For example, when sodium borohydride is used as the reducing agent, the concentration (initial concentration) of of the metal complex peptide lipid may conveniently be 0.1–1 mmol per litre, and when hydrazine is used as the reducing agent, the concentration (initial concentration) of the metal complex peptide lipid may conveniently be 10–15 mmol per litre. If the colloidal dispersion is too thin, no structure of any kind can be formed, whereas if it is too dense, large lumps are produced and the copper nanowire cannot be formed.

In this way, when the reducing agent is added while stirring the colloidal suspension, this solution gradually changes and forms a metal nanowire after several hours. The length of this metal nanowire is an average of 1 $\mu$m or more, preferably 1 mm or less, more preferably 100 $\mu$m or less and still more preferably 1–10 $\mu$m. This length naturally varies with the manufacturing conditions. Also, as seen from the photographs (FIGS. 1 and 2) shown in the following examples, various lengths of this metal nanowire may be mixed together, but the salient feature is that they comprise wires of 1 $\mu$m or more, and this length had not been observed in the prior art. The long wire may be extracted by any method, or it may be used in admixture with shorter wires. The diameter of this metal nanowire is an average of 10–20 nm. Nanowires of diameters outside this range may also be present depending on the manufacturing conditions, but it is considered that, on average, the diameter lies within this range, as seen from the following examples.

This invention will now be described by way of specific examples, but it must be understood that the invention is not to be construed as being limited in anyway thereby.

MANUFACTURING EXAMPLE 1

10.9 g (50.0 mmol) of t-butyloxycarbonyl-L-valine, 19.0 g (50.0 mmol) of p-toluene sulfonic acid salt and 7.0 ml (50.0 mmol) of triethylamine were dissolved in 150 ml of dichloromethane, 100 ml of a dichloro methane solution containing 10.5 g (55.0 mmol) of 1-ethyl-3-(3-dimethylaminopropyl) carboimido hydrochloride were added at −5 degree C. with stirring, and stirring was continued for 24 hours. This dichloromethane solution was washed twice with each of a 10 wt % of citric acid aqueous solution, water, 4 wt % sodium bicarbonate aqueous solution and water, and the organic layer was dried over anhydrous sodium sulfate. The solvent was distilled off completely under reduced pressure to give a colorless, transparent oil of t-butyloxycarbonyl-L-valyl-L-valinebenzylester. This oil was dissolved in 100 ml of ethyl acetate, 120 ml 4N-hydrochloric acid/ethyl acetate was added, and the mixture stirred for 4 hours. The solvent was distilled off completely under reduced pressure, diethyl ether was added to wash the white precipitate well, and 13.8 g of a white solid of L-valyl-L-valinebenzylester hydrochloride was obtained (yield 80%).

0.46 g (2 mmol) of 1,10-decanedicarboxylic acid and 0.674 g (4.4 mol) of 1-hydroxybenzotriazole were dissolved in N,N-dimethylformamide, and 10 ml of a dichloromethane solution containing 0.90 g (4.4 mmol) of 1-ethyl-3-(3-dimethylaminopropyl) carboimido hydrochloride was added at −5 degree C. with stirring. After 1 hour, 10 ml of dichloromethane solution containing 1.51 g (4.4 mmol) of the above L-valyl-L-valinebenzylester hydrochloride followed by 0.62 ml (4.4 mmol) of triethylamine were added, and stirred for 24 hours while gradually returning to room temperature. The solvent was completely distilled off under reduced pressure, and the white precipitate obtained was washed on filter paper successively with 50 ml of 10 wt % citric acid aqueous solution, 20 ml water, 50 ml of 4 wt % sodium bicarbonate aqueous solution and 20 ml water. 0.98 g of N,N'-bis (L-valyl-L-valinebenzylester) decane-1,10-dicarboxamide was obtained as a white solid (yield 0.61%). 0.5 g (0.62 mmol) of this compound was dissolved in 100 ml dimethylformamide, 0.25 g of 10 wt % palladium/carbon was added as a catalyst, and catalytic hydrogenation was performed. After 6 hours, the catalyst was filtered off using cerite, and the solvent was distilled off under reduced pressure to obtain a colorless oil. The oil obtained was crystallized using a water-ethanol mixed solvent to give a white solid. After analysis, this white solid was N,N'-bis (L-valyl-L-valine) decane-1,10-dicarboxamide (corresponds to m=2, n=10 in general formula (1)).

EXAMPLE 1

0.1 mmol of the two-headed peptide lipid obtained in Manufacturing Example 1 was taken in a sample bottle, 100 ml of distilled water containing 8.0 mg (0.20 mmol) of sodium hydroxide (2 equivalents) was added, and the two-headed peptide lipid was dissolved by applying ultrasonic irradiation (pass type).

Figure 2:
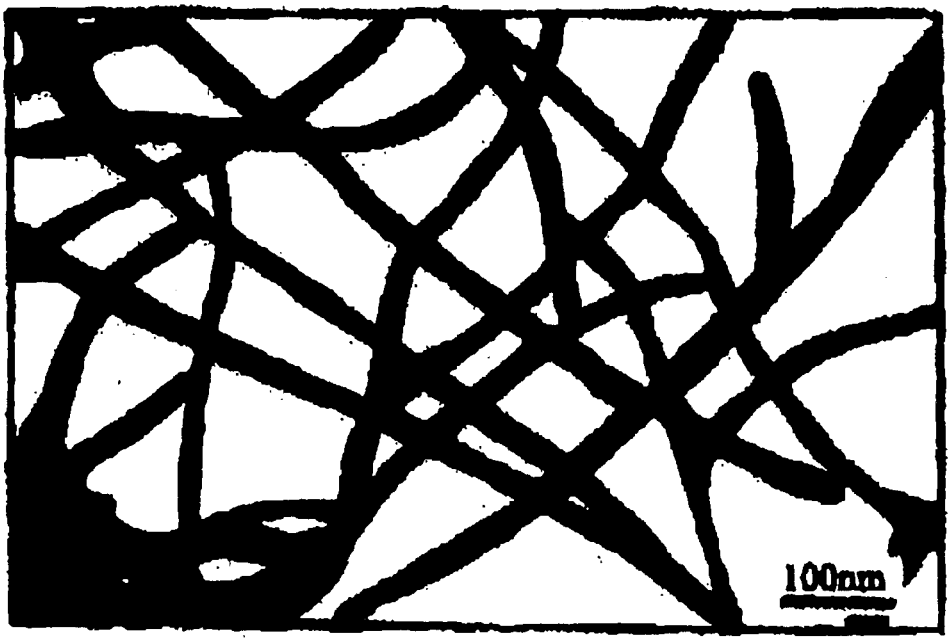
FIG. 2 is a diagram which traces the transmittance electron micrograph of the copper nanowire obtained in Example 1.

This aqueous solution was maintained at room temperature while stirring vigorously over a hot stirrer. When 1 ml of 0.1 mol/liter of copper (II) acetate was added, the solution gradually became cloudy, and a blue collolidal dispersion was formed. This blue colloidal dispersion was stirred at room temperature in the atmosphere. When 100 ml (0.5 mmol) of 5 mmol/liter of sodium borohydride aqueous solution was added, the solution immediately turned blackish brown, and after about 6 hours, a dark grey filamentous precipitate formed. When this filamentous precipitate was examined under a transmission electron microscope, spherical structures of diameter several tens-several hundred nanometers, and the formation of a copper nanowire, were observed. FIG. 1 and FIG. 2 show transmission electron micrographs of the copper nanowire obtained. As can be seen from these photographs, the average diameter of this copper nanowire was 10–20 nm and its average length was 1–10 $\mu$m or more.

EXAMPLE 2

1.0 mmol of the two-headed peptide lipid obtained in Manufacturing Example 1 was taken in a sample bottle, 100 ml of distilled water containing 80.0 mg (2.0. mmol) of sodium hydroxide (2 equivalents) was added, and the two-headed peptide lipid was dissolved by applying ultrasonic irradiation (pass type).

This aqueous solution was maintained at room temperature while stirring vigorously over a hot stirrer. When 1 ml of 0.1 mol/liter of copper (II) acetate was added, the solution gradually became cloudy, and a blue collolidal dispersion was formed. This blue colloidal dispersion was stirred at room temperature in the atmosphere. When 9.2 ml (10 mmol) of a 35 wt % hydrazine aqueous solution was added, the solution immediately turned yellow, and after about 6 hours, a yellow colloidal precipitate formed. When this filamentous precipitate was examined under a transmission electron microscope, the formation of a copper nanowire having a length of several—several hundred $\mu$m and a diameter of several nanometers, was observed.

According to this invention, a metal nanowire having an average length of 1 $\mu$m or more, which could not be produced from a synthetic compound until now, can easily be manufactured under the mild conditions of room temperature and atmospheric pressure. As the nanowire of this invention comprises only metals, it is electrically conducting, and has manifold industrial applications, such as in the electronics/information fields which use nanoelectron parts and nanomagnetic materials.

What is claimed is:

1. A method of manufacturing a metal nanowire, which comprises the step of reducing a nanofiber comprising a metal complex peptide lipid formed from the two-headed peptide lipid represented by the general formula (I):

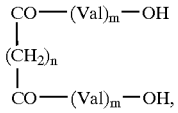

(I)

in which Val is a valine residue, m is 1–3 and n is 6–18, and a metal ion, using 5–10 equivalents of a reducing agent relative to the two-headed peptide lipid.

2. The method of manufacturing the metal nanowire as defined in claim 1, wherein a nanofiber, wherein the initial concentration of the metal complex peptide lipid is 0.1–1 mmoles/liter, is reduced in aqueous solution using copper (II) ion as the metal ion and sodium borohydride as the reducing agent.

3. The method of manufacturing the metal nanowire as defined in claim 1, wherein a nanofiber, wherein the initial concentration of the metal complex peptide lipid is 10–15 mmoles/liter, is reduced in aqueous solution using copper (II) ion as the metal ion and hydrazine as the reducing agent.

4. The metal nanowire having an average diameter of 10 to 20 nm and an average length of 1 $\mu$m or more, which is produced by the method of claim 1.

5. A metal nanowire having an average diameter of 10 to 20 nm and an average length of 1 $\mu$m or more, which is produced by the method of claim 2.

6. A metal nanowire having an average diameter of 10 to 20 nm and an average length of 1 $\mu$m or more, which is produced by the method of claim 3.

7. A metal nanowire having an average diameter of 10 to 20 mn and an average length of 1 micron or more, which is produced using as a template a nanofiber comprising a metal complex peptide formed from the two-headed peptide lipid represented by the general formula (I):

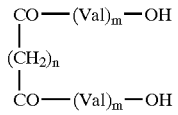

(I)

in which Val is a valine residue, m is 1–3 and n is 6–18, and a metal ion.

8. The metal nanowire as defined in claim 7, wherein the metal is copper.

* * * * *